United States Patent [19]

Grigorenko et al.

[11] 4,186,587

[45] Feb. 5, 1980

[54] FORGING PRESS

[76] Inventors: Anatoly S. Grigorenko, ulitsa Tovstukho, 1, kv. 21; Jury A. Moroz, ulitsa Fugenfirova, 11, kv. 91; Leonid I. Kortusov, prospekt Mira, 57a, kv. 10; German N. Kuznetsov, ulitsa Romanenko, 8, kv. 46; Nina A. Franchenko, ulitsa 4 Severnaya, 126, all of Omsk, U.S.S.R.

[21] Appl. No.: 932,115

[22] Filed: Aug. 9, 1978

[51] Int. Cl.[2] ..... B21J 13/02

[52] U.S. Cl. ..... 72/354; 72/360; 72/407

[58] Field of Search ..... 72/354, 407, 360, 355, 72/358, 391, 453.03, 453.18

[56] References Cited

U.S. PATENT DOCUMENTS

| | | | |
|---|---|---|---|
| 1,910,384 | 5/1933 | Eksergian | 72/360 |
| 2,886,836 | 5/1959 | Moeltzner | 72/391 |
| 4,027,518 | 6/1977 | Ribback | 72/407 |
| 4,069,700 | 1/1978 | Bocharov | 72/407 |

*Primary Examiner*—Francis S. Husar
*Assistant Examiner*—Gene P. Crosby
*Attorney, Agent, or Firm*—Burgess, Ryan and Wayne

[57] ABSTRACT

The disclosure relates to forging and pressing equipment, particularly, to presses exerting double action upon work. The press of the present invention comprises rams carrying males dies and rams carrying female die halves, mounted on the press framework for opposing reciprocation and associated with their own independent drives. The framework also supports a mechanism for clamping the female die halves, incuding, in accordance with the invention, wedges reciprocably mounted on the framework. The said wedges engage the rams carrying the female die halves along sloping planes provided on the last-mentioned rams at the sides adjacent to the male die-carrying rams, the wedges associated with different rams being coupled with one another and with their drive by a rocker arm spring-urged relative to the framework. The press can be used to advantage for making forgings of the pinion-and-hub type, flanged articles and the like, providing as it does reliable clamping of the female die halves throughout the pressing operation and thus preventing formation of flash along the plane of the opening of the female die halves, the press also providing for dimensional accuracy of the forgings, alongside of high capacity.

3 Claims, 2 Drawing Figures

FORGING PRESS

The present invention relates to pressing and forging machines, and more particularly it relates to presses exerting double action upon work.

Recently, the development of the engineering of pressing and forging machines has been noticeably directed toward creation of specialized presses, e.g. those capable of pressing or stamping in closeable die sets with detachable dies.

Known in the art is that pressing or stamping in closed die sets is a very efficient technique of obtaining accurately dimensioned articles by three-dimensional deformation in the closed space. This is performed by special-purpose presses incorporating mechanisms for closing and opening the tool means, i.e. the die sets, such presses being capable of turning out such forged or stamped articles as gears with hubs, flanged articles, etc.

Among presses serving this purpose there are known ones including two rams, i.e. the external and internal rams. The external ram is designed to close and clamp the die set, whereas the internal one actually effects deformation of the workpiece in the closed die space. These presses perform stamping or pressing with a single-side action upon the work.

However, for certain types of stamped articles, e.g. the shaft-and-pinion type, it is necessary that the work should undergo deformation in a closed die set with a double-side or simply double action upon this work.

The double-side deformation technique is preferable to the single-side one in that it offers a symmetric propagation of plastic deformation and is devoid of restriction of the flow of the metal, as is the case with single-side deformation, with the energy losses on the friction of the metal against the die walls reduced, as well as the specific effort required.

There is known a press exerting double action upon work, comprising a horizontal framework supporting opposingly reciprocable rams carrying the female die halves and rams carrying the male dies, with an independent drive of each ram.

The rams carrying the female die halves are driven by power hydraulic cylinders which, upon the female dies having closed upon each other, supply the clamping effort throughout the stamping or pressing operation (see the Soviet Union Inventor's Certificate No. 294,411).

In the abovementioned press the female die halves are clamped together during the pressing operation by the power cylinders which also serve as the drive of the reciprocation of the rams carrying the female die halves.

To ensure adequately reliable clamping of the female die halves during the pressing operation and thus to preclude the appearance of flash along the plane of the engagement of the female die halves, a clamping force is required the valve of which can be as high as the deformation force. Such a force can only be provided by power cylinders of considerable dimensions.

On the other hand, the rate of the motion of the rams should be relatively high, for the hot work not to cool down and for the throughput of the press to be adequately high.

To meet the above requirements, i.e. that of the sufficiently great effort and that of the adequately high rate, in the abovedescribed known press, the energy consumption figure is to be relatively high, with the efficiency factor of the press being affected correspondingly.

The main object of the present invention is to provide a press which should ensure reliable clamping together of the female die halves.

It is another object of the present invention to provide a press which should offer adequately high throughput.

It is still another object of the present invention to provide a press which should provide for accurate dimensions of the articles turned out by the press.

These and other objects of the present invention are attained in a press exerting double action upon work, comprising: a framework, male dies; female die halves; rams carrying said male dies; rams carrying said female die halves; said rams being mounted on said framework for opposing reciprocation; independent drive means associated with each one of said rams; mechanism adapted to clamp together said female die halves during the pressing operation, including wedges mounted on said framework for reciprocation and adapted to engage said rams carrying said female die halves along sloping planes provided on said last-mentioned rams, on the sides adjacent to said rams carrying said male dies, said wedges cooperating with different ones of said rams being connected with one another and with their drive by a rocker arm spring-urged relative to said framework.

In the press constructed in accordance with the present invention the mechanism for clamping the female die halves during a pressing operation reliably holds them together and thus precludes the appearance of a flash along the die-opening plane, while maintaining the adequately high dimensional accuracy of the pressed or stamped articles. This is attained owing to the fact that the wedges multiply the effort produced by the power cylinder.

The press of the present invention consumes in operation significantly less energy than the hitherto known similar presses, while offering a higher efficiency factor. This is attained owing to the mechanism clamping together the female die halves being of the wedge type, whereby the cylinders driving the rams carrying the female die halves serve only to move these rams and so can have smaller dimensions, with the corresponding reduction of the energy consumption, since both the stroke and the actuation speed of these cylinders have to be relatively great.

It is expedient that the drive of the reciprocating wedges should include a power cylinder having its movable part pivotally connected with a slide block mounted for reciprocation in one of the arms of a lever pivotally mounted on a spindle supported by the framework, the other arm of the layer cooperating through a spherical foot and a foot bearing with the rocker arm along the axis of symmetry of the latter.

This construction of the wedge-actuating drive is structurally simple, easy to manufacture and dependable in operation.

It is also expedient that the press should have on its framework lugs parallel with the plane of the engagement of the female die halves, against which the rams carrying the female die halves are adapted to abut upon the die halves closing upon each other.

This feature provides for an accurately determined position of the rams carrying the female die halves relative to the axis of symmetry of the press, and thus for reliable clamping of the female die halves by the wedges.

Given hereinbelow is a description of an embodiment of the invention, with reference being made to the accompanying drawings, wherein.

Figure 1:
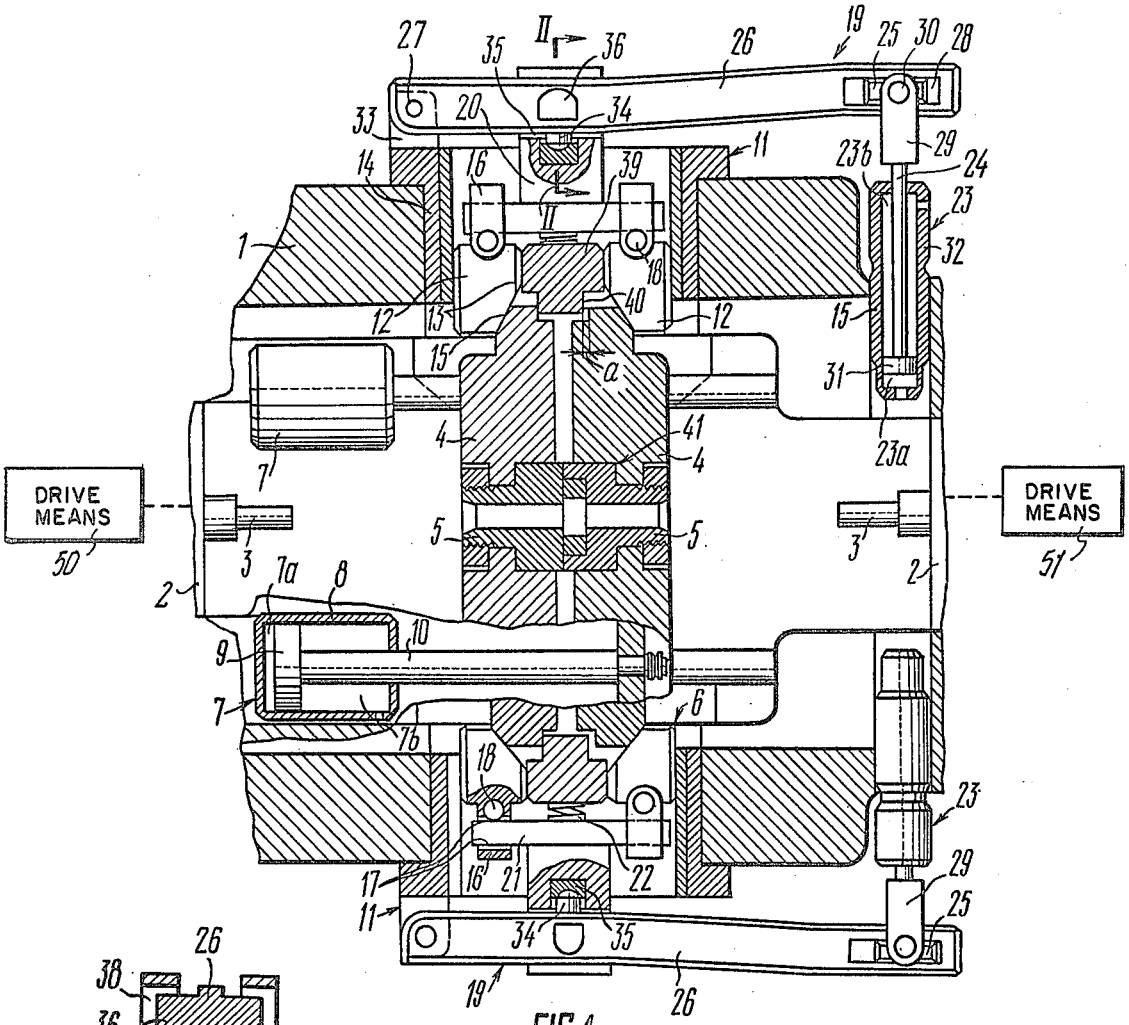
FIG. 1 is a longitudinal sectional view of a press exerting double action upon work, embodying the invention.

Referring now to the drawings, the press has a framework 1 supporting thereon oppositely reciprocable rams 2 carrying male dies 3 and rams 4 carrying female die halves 5. The reciprocation of the rams 2 and 4 is provided for by their being accommodated in respective guideways 6 provided in the framework 1.

The independent drive means (50 and 51) of the rams 2 are operable to drive the male dies 3 through working and idle strokes.

The independent drive of each ram 4 is its respective power cylinder 7 which is responsible for opening and closing of the female die halves 5.

Each power cylinder 7 has a housing 8 mounted on the framework 1 and having an internal space accommodating a piston 9 rigidly connected with a piston rod 10 and dividing the internal space of the housing 8 into the above-piston space 7*a* and the under-piston or piston rod space 7*b*.

The free end of the piston rod 10 is connected with the respective ram 4.

To hold together the female die halves 5 in the closed position throughout the stamping or pressing operation, the mechanisms 11 for clamping the female die halves 5 are provided.

In accordance with the invention, each mechanism 11 for clamping the female die halves 5 includes wedges 12 mounted for reciprocation on the framework 1.

The reciprocation of the wedges 12 is provided for by their being mounted in rectangular openings 13 of a housing 14.

The wedges 12 are adapted to cooperate with inclined or sloping planes 15 provided on the rams 4 carrying the female die halves 5, on the sides adjacent to the rams 2 carrying the male dies 3.

Each wedge 12 has a tail portion 16 having made therein a rectangular opening 17 and also having mounted therein a cylindrical stud 18.

The wedges 12 cooperating with the respective different rams 4 are connected with each other and with their drive 19 by a rocker arm 20.

This connection includes lugs 21 provided on the rocker arm 20 and received in the openings 17 of the tail portions 16.

The rocker arm 20 is spring-urged relative to the framework 1 by a spring 22.

The drive 19 responsible for reciprocation of the wedges 12 includes a power cylinder 23 having its movable member, i.e. its piston rod 24 in the presently described embodiment, pivotally connected with a slide block 25 accommodated for reciprocation in one of the arms of a lever 26 pivotally mounted on a spindle 27 carried by the framework 1 of the press.

The reciprocation of each slide block 25 is provided for by its being mounted in a rectangular opening 28 made in the end portion of the lever 26. The pivotal connection between the slide block 25 and the piston rod 24 includes a bifurcated member 29 fixed on the end of the piston rod 24 and pivotally connected with the slideblock 25 by means of a pivot pin 30.

The other end of the piston rod 24 is rigidly connected with a piston 31 received in the housing 32 of the power cylinder 23, mounted on the framework 1, and defining therein two spaces, viz. the above-piston one 23*a* and the under-piston one 23*b*.

The pivotal connection of the arm 26 with the framework 1 includes a bifurcated lug 33 provided on the housing 14 and connected with the arm 26 by means of the spindle 27.

The other arm of the lever 26 cooperates with the rocker arm 20 along the latter's axis of symmetry by means of a spherical foot 34 and a foot bearing 35.

In the presently described embodiment the lever 26 is a lever of the second kind, and, therefore, the point of its interaction with the rocker arm 20, defining its "other arm", is disposed centrally of the lever 26, closer to its pivot 27.

At this point the lever 26 is provided with lugs 36 having the foot 34 rigidly fixed thereto, while the foot bearing 35 is mounted in a respective cavity provided in the body of the rocker arm 20.

Figure 2:
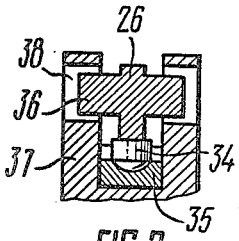
FIG. 2 is a sectional view taken on line II—II of FIG. 1.

In addition to the lugs 21, the rocker arm 20 also has two more lugs 37 (FIG. 2) with openings 38 made therein to accommodate the lugs 36 of the lever 26.

The framework 1 is provided intermediate the wedges 12 with lugs 39 of which the side planes 40 are parallel with the plane of the closing or engagement of the female die halves 5, against which lugs 39 the rams 4 carrying the female die halves 5 are adapted to abut upon the latters' closing.

In the presently described embodiment the lugs 39 are provided on the housing 14 where the wedges 12 are mounted.

The press operates, as follows.

Prior to the male dies 3 being driven through a working stroke, the female die halves are to have been closed to define a closed die space 41.

This is done by connecting the under-piston spaces 7*b* of the power cylinders 7 to a pressure source (not shown), and connecting the above-piston spaces 7*a* to drain. The effort developed in this manner by the cylinders 7 is transmitted via the piston rods 10 to the rams 4, whereby the latter are driven along the guideways 6 of the framework 1. At the end of this stroke one of the rams 4 abuts against the planes 40 of the respective lugs 39, while the other ram is stopped short of the adjacent plane 40 by a clearance "a", since the two female die halves 5 abut against each other along their engagement plane.

The value of this clearance "a" is selected so that the offsetting of the rams 4 relative to the axis of symmetry of the lugs 39, equalling a/2, should not affect the conditions of clamping the rams 4 by the wedges 12.

After the female die halves 5 having closed upon each other, the under-piston spaces 23*b* of the cylinders 23 are connected to the pressure source, and their above-piston spaces 23*a*—to drain.

The effort developed by the cylinder 23 thus energized is transmitted via the piston rod 24, the bifurcated member 29 and the slide block 25 to the lever 26 which pivots about its pivot spindle 27.

The motion of the lever 26 is transmitted via the foot 34 and the foot bearing 35 to the rocker arm 20 which drives the wedges 12 into engagement with the sloping or skewing planes 15 of the rams 4, as shown in FIG. 1.

On account of the slight asymmetry of the position of the rams 4 with respect of the lugs 39, the wedges 12 are driven through different distances at the closing of the die set. This, however, is compensated for by corresponding inclination of the rocker arm 20 which cooperates with the wedges 12 through the generatrices of the respective cylindrical studs 18 and thus applies equal efforts to the wedges 12 cooperating with the respective different rams 4.

These vertical efforts applied to the wedges 12 are transmitted via the sloping planes 15 to the rams 4, whereby horizontal efforts clamping together the female die halves 5 at their engagement plane are developed.

With the female die halves 5 thus closed and clamped together, a hot workpiece (not shown) is introduced laterally into the pressing space 41.

Then the rams 2 carrying the male dies 3 are driven through their working stroke with the help of the drive means 50 and 51. At the end of the stroke they enter the inlets of the female die halves 5 and shape the workpiece by deformation in the closed die space 41.

Having completed their working stroke, the rams 2 with the male dies 3 are returned into their initial positions, i.e. driven through an idle stroke.

Following the completion of the stamping operation, the clamping mechanism 11 is to be returned into its initial position, too. This is done by connecting the spaces 23*a* of the cylinders 23 to the pressure source, and their spaces 23*b*—to drain. Under the action of the pressure thus supplied, the rods 24 rotate the levers 26 about their respective pivot spindles 27, away from the framework 1, whereby the levers 26 have their lugs 36 cooperating with the openings 38 in the lugs 37 of the rocker arms 20, displacing the latter.

Jointly with the rocker arms 20, the wedges 12 are likewise translated, since their lugs 21 received in the openings 17 of the tail pieces 16 cooperate with the respective rocker arms 20.

Thus, the wedges 12 are retracted from the rams 4 and are completely withdrawn into the framework 1 at the end of their return stroke.

The above-piston spaces 7*a* of the cylinders 7 are now communicated with the pressure source, and the under-piston spaces 7*b*—with drain.

Consequently, the rods 10 drive the rams 4 toward the rams 2, and at the end of this stroke of the rams 4 a finished forging or stamping is ejected. Following the ejection, the rams 4 are driven together once again, the mechanism 11 is operated to clamp the female die halves 5 together, and the above-described operating cycle of the press can be repeated.

We claim:

1. A press exerting double action upon a workpiece, comprising: a framework; male dies and female die halves; rams carrying said male dies; rams carrying said female die halves and having sloping planes on the sides adjacent to the respective ones of said male dies; said rams carrying said male dies and said rams carrying said female die halves being mounted on said framework for opposing reciprocation; independent drive means for each of said ram; a mechanism adapted to clamp said female die halves together for a stamping operation, comprising wedges mounted for reciprocation on said framework and adapted to cooperate with said rams carrying said female die halves along said sloping planes of said rams carrying said female die halves; rocker arm means interconnecting said wedges adapted to cooperate with different ones of said rams and connecting them with their drive means; spring means urging said rocker arm means with respect of said framework.

2. A press as set forth in claim 1, wherein the drive means for effecting reciprocation of said wedges includes a spindle mounted on said framework; a spherical foot; a foot bearing; a lever having one end pivotally mounted on said spindle and having its arm interacting through said spherical foot and said foot bearing with said rocker arm means along the latter's axis of symmetry; a slide block mounted for reciprocation in the other end of said arm of said lever, and; a power cylinder having a movable member pivotally connected with said slide block.

3. A press as set forth in claim 1, wherein said framework has lugs provided thereon intermediate of said wedges, said lugs having side planes arranged parallel with the closing plane of said female die halves, which said rams carrying said female die halves are adapted to engage at closing of said female die halves.

* * * * *